US010688014B2

(12) United States Patent
Muller

(10) Patent No.: US 10,688,014 B2
(45) Date of Patent: Jun. 23, 2020

(54) MASSAGE APPARATUS WITH KNUCKLE-SHAPED NODES

(71) Applicant: Geoffrey M. Muller, San Francisco, CA (US)

(72) Inventor: Geoffrey M. Muller, San Francisco, CA (US)

( * ) Notice: Subject to any disclaimer, the term of this patent is extended or adjusted under 35 U.S.C. 154(b) by 901 days.

(21) Appl. No.: 15/176,203

(22) Filed: Jun. 8, 2016

(65) Prior Publication Data

US 2016/0361223 A1 Dec. 15, 2016

Related U.S. Application Data

(60) Provisional application No. 62/173,246, filed on Jun. 9, 2015.

(51) Int. Cl.
*A61H 7/00* (2006.01)
*A61H 15/00* (2006.01)

(52) U.S. Cl.
CPC ..... *A61H 7/002* (2013.01); *A61H 15/00* (2013.01); *A61H 7/003* (2013.01); *A61H 15/0092* (2013.01); *A61H 2015/0042* (2013.01); *A61H 2201/0126* (2013.01); *A61H 2201/0153* (2013.01); *A61H 2201/1261* (2013.01); *A61H 2201/1695* (2013.01); *A61H 2203/0406* (2013.01); *A61H 2203/0431* (2013.01); *A61H 2203/0437* (2013.01)

(58) Field of Classification Search
CPC .... A61H 7/002; A61H 7/003; A61H 15/0092; A61H 2015/0042; A61H 2201/0153; A61H 2201/1261; A61H 2201/0126; A61H 2201/1695; A61H 1/008; A61H 15/00; A63B 37/00; A63B 37/14; A63B 43/00; A63B 43/002; A63B 43/02
See application file for complete search history.

(56) References Cited

U.S. PATENT DOCUMENTS

| | | | | |
|---|---|---|---|---|
| 563,170 | A | 6/1896 | Haley | |
| 744,718 | A * | 11/1903 | Cassidy | 473/614 |
| 1,299,092 | A | 4/1919 | Abrahamson | |
| 1,481,038 | A * | 1/1924 | Stephenson | A61H 15/00 601/121 |
| 1,554,510 | A * | 9/1925 | Kirby | A47K 7/02 15/188 |
| 2,078,382 | A | 4/1937 | Hanshaw | |
| 2,286,324 | A | 6/1942 | Wentz | |
| 2,362,064 | A | 11/1944 | Giesinger | |
| 2,466,470 | A | 4/1949 | Norris | |
| 4,191,178 | A | 3/1980 | Wisnieski | |
| 4,308,860 | A | 1/1982 | Sanders | |
| 4,463,485 | A * | 8/1984 | Gueret | A46B 1/00 601/137 |

(Continued)

*Primary Examiner* — Valerie L Woodward
(74) *Attorney, Agent, or Firm* — Richard Batt

(57) ABSTRACT

A massage apparatus has a spherical-shaped body and a plurality of knuckle-shaped nodes protruding from a surface of the body for myofascial release of tissue adhesions, scar tissue, and trigger points. The protruding nodes are arranged in parallel rows and located on one hemispherical face of the sphere. The nodes vary in height along a row. The rows are preferably spaced sufficient to enable effective rolling of the sphere along a spinous process of the user and without coming into contact with the vertebrae of the user.

17 Claims, 4 Drawing Sheets

(56) References Cited

U.S. PATENT DOCUMENTS 4,622,956 A * 11/1986 Nesheim ..... A61H 15/0092 601/119
4,648,387 A 3/1987 Simmons
4,846,159 A 7/1989 Anzai
D309,660 S 7/1990 Saguin
D317,805 S 6/1991 Swan
5,028,053 A 7/1991 Leopold
5,131,665 A 7/1992 Myers
5,251,908 A 10/1993 Myers
D358,858 S 5/1995 McGreevy
5,577,996 A 11/1996 Gardner
D393,671 S 4/1998 Honaker
D404,974 S 2/1999 Kristinik
5,893,808 A * 4/1999 Bennett ..... A63B 65/06 473/451
5,906,530 A 5/1999 Lindsey
6,013,042 A 1/2000 Sakai
D435,660 S 12/2000 Yoo
6,241,696 B1 6/2001 York
6,245,031 B1 6/2001 Pearson
D456,570 S 4/2002 Tsengas
6,379,212 B1 4/2002 Miller
6,432,071 B1 8/2002 Hsieh
6,443,863 B1 9/2002 Dinoffer
D478,367 S 8/2003 Traub
D516,640 S 3/2006 Shore
D524,445 S * 7/2006 Liang ..... D24/211
7,238,161 B2 7/2007 Komkin
7,413,524 B1 4/2008 Bibby
7,458,945 B2 12/2008 Zemont
D585,162 S 1/2009 Partain
D599,963 S 9/2009 Crane
D601,645 S 10/2009 Chapa, Jr.
D617,395 S 6/2010 Colangelo
D619,663 S 7/2010 Quinn
D625,426 S 10/2010 Robins
D626,610 S 11/2010 Grimm
D626,705 S 11/2010 Rutherford
D629,056 S 12/2010 Grimm
D650,874 S 12/2011 Williams
D695,371 S 12/2013 Hedeen, Jr.
8,714,853 B2 * 5/2014 Sutcliffe ..... A45D 34/041 401/28
9,039,641 B1 5/2015 Johnson
9,597,254 B1 * 3/2017 Bhatt ..... A61H 7/007
9,962,309 B2 * 5/2018 Connors ..... A61H 1/008
2004/0006294 A1 1/2004 Zemont
2004/0181892 A1 * 9/2004 Chen ..... A47K 7/028 15/209.1
2004/0230146 A1 11/2004 Chang
2005/0033205 A1 2/2005 Komkin
2006/0089578 A1 4/2006 Hsu
2006/0135299 A1 * 6/2006 Hochstrasser ..... A63B 37/14 473/594
2006/0161080 A1 * 7/2006 Chen ..... A61H 7/003 601/131
2008/0039747 A1 2/2008 Baerwalde
2009/0182249 A1 * 7/2009 Sakai ..... A61H 7/005 601/136
2009/0300933 A1 12/2009 Howe
2013/0190664 A1 * 7/2013 Johnson ..... A61H 15/0092 601/129

* cited by examiner

MASSAGE APPARATUS WITH KNUCKLE-SHAPED NODES

CROSS-REFERENCE TO RELATED APPLICATIONS

The present application claims the benefit of provisional application No. 62/173,246, filed Jun. 9, 2015, and entitled "Knuckleball."

BACKGROUND OF THE INVENTION

Technical Field

The invention relates to massage apparatus, more particularly to massage balls with numerous protrusions or "knuckles" of varying size and spacing. Non-limiting exemplary applications include myofascial release of tissue adhesions, scar tissue, and trigger points.

Background Information and Prior Art

Poor posture, lack of flexibility, injury, and overuse are all contributors to myofascial pain and stiffness. Trigger points, fascia adhesions, and scar tissue all contribute to chronic pain conditions affecting the normal function of muscles and connective tissue. Myofascial and trigger point release through the application of pressure to the affected muscle or connective tissue provides effective relief through the elimination of the immobile or stiff areas causing pain.

Myofascial release involves the application of slow and sustained pressure to the connective muscle tissue in an attempt to elongate the fascia to relieve pain and restore motion. This is a general technique often used in massage. Trigger points (TrP) are generally considered to be knots in the skeletal muscle tissue. They tend to form in areas where different skeletal muscles integrate at specific points on the body. TrP can present as tightness or tenderness in the muscle tissue or areas of pain accompanied by a restricted range of motion. Multiple trigger points can form a patch of contracted muscle tissue, resulting in myofascial pain syndrome. These areas of affected muscle tissue are typically cut off from their blood supply, causing direct pain, complicating existing injuries, or mimicking other problems (sciatica for example). TrP located in one area of the body can produce referral pain in another area. For example, a TrP located in the lower right side portion of the neck (scalene) can produce pain along the same side in the front chest, front shoulder, back of the arm, along the thumb and wrist.

Professional methods of relief may include massage, chiropractic care, acupuncture, or injections in an attempt to release the contracted muscle tissue.

Various types of balls (both athletic and massage) have been used in an attempt to find relief from the underlying conditions attributed to myofascial pain and stiffness. Tennis balls, lacrosse balls, softballs, each with varying size and density may provide some relief, but they are all consistently round in shape, and the user may have difficulty targeting the tissue adhesions and trigger points. The round surface also makes it difficult to center and maintain direct pressure on those areas where the muscle exhibits a "knot".

One example of a massage ball is disclosed in U.S. Pat. No. 7,156,817 to Cassidy Phillips. This device consists of a multi-layered massage ball with an inner core designed to mirror the hardness of a human thumb. While a user might locate a trigger point, the deformation characteristics as well as the minimum circumference of the ball (3.5 cm) can limit the penetration into the affected muscle tissue, making the device less effective in providing trigger point release.

Another example is disclosed in U.S. Pat. No. 7,517,324 to Cohen. The therapeutic ball exhibits a plurality of different sized projections with a gap along the equatorial seam to accommodate the spinous process. While the close proximity of the projections (6-16/in$^2$) as well as their small size (≤0.21 in) might be effective for general massage and muscle tension relief, they make it difficult to target and apply the required direct pressure needed to release trigger points.

Another example is disclosed in U.S. Pat. Pub. No. 20040006294 to Zemont. The device has an array of 10 evenly spaced pliable nodes on the entire surface of the ball, which require the user to reposition the device to a greater degree in order to successfully target a single trigger point. The sparse spacing and height of the nodes result in clunky operation when attempting to roll against a rigid surface further affecting a user's ability to easily locate the trigger point. Additionally, the nodes might interfere with the ability of a second user to grasp the device and apply the direct necessary pressure to provide relief.

Another example is disclosed in U.S. Pat. No. 9,039,641 to Johnson. The apparatus consists of at least 20, and in some cases 30-32 massage fingers with outward facing tips. While the large number of fingers allows for smoother manipulation than other devices with protrusions, the close proximity can inhibit targeting of trigger points deeper in the skeletal muscle tissue. Also, the device cannot be used along the spinous process due to the close proximity of the fingers (contact with the vertebrae). Additionally, the small diameter (8 cm) of the device requires a separate base to elevate it to accommodate a larger user or denser area of muscle tissue. When the device is in a fixed position in the base, the user will have to continually reposition their body to locate the area of interest. A second user may experience discomfort while using the device on an intended recipient due to the numerous fingers pressing into the second user's hand.

Massage balls [Pro-tecathletics.com (Dr. Cohen's Acuball), Amazon.com/Body-Back-Company (Rhino Balls)], both with small bumps or spikes on the surface might make it easier to remain on the points of interest, but the low profile of the bumps or close proximity of the spikes limit the penetration into the muscle. This results in only superficial stimulation of the myofascial tissue and doesn't place the direct pressure necessary to break up trigger points and adhesions.

Other massage balls have larger bumps or protrusions spaced along the entire surface of the ball. The problem is that the bumps are too far apart for the ball to roll effectively on a surface (e.g., Healthybodyball.com (Healthy Body Ball), U.S. Pat. No. 7,458,945), resulting in constant repositioning of the device or clunky operation that makes working on larger areas difficult.

Additionally, products such as that described above in connection with the '641 patent may require the use of a separate base for stability when used against a wall or other surface, or to target a specific trigger point accurately. Additionally, its small size (3 inches) may require the user to elevate the device to achieve the proper penetration into the specific muscle group targeted. The equal spacing, size, and large number of protrusions on the ball may also interfere with each other, limiting the user's ability to target and penetrate specific muscles and connective tissue to find relief. Because of various limitations, these massage balls are limited in their effectiveness, difficult to use, only available in one size, or may require additional equipment for use to relieve various myofascial conditions.

Accordingly, an improved massage apparatus is desired that overcomes the challenges described above is desired. An improved massage apparatus is desired that provides greater control, variation, and function through smoother operation and more specific targeting of myofascial pain without constant repositioning or the need for additional equipment.

SUMMARY OF THE INVENTION

A massage ball with integrated knuckles designed for myofascial release.

In embodiments, a massage apparatus comprises a spherical-shaped body defining a first hemispherical face and a second hemispherical face opposite the first face. The massage apparatus further comprises a first row of protruding nodes located in the first face and a second row of protruding nodes located in the first face and parallel to the first row.

In embodiments, the second face is node-less.

In embodiments, the protruding nodes of the first row vary in size in a first direction.

In embodiments, the protruding nodes of the first row increase in size sequentially in a first direction and the protruding nodes of the second row sequentially decrease in size in the first direction.

In embodiments, the first row and second row are the only rows of protruding nodes in the first face.

In embodiments, each of the nodes has a conical shape including an enlarged base and an oval-shaped top smaller in diameter than the base. The top of each node may be rounded or flat. The base of each node may be filleted (rounded or beveled). In embodiments, each node ranges in diameter from 0.25 to 1 inch.

In embodiments, the nodes are arranged on the ball such that a center to center spacing between each adjacent node is in the range between 0.50 and 2.0 inches at the top.

In embodiments, a method for myofascial release and relief of tissue adhesions, scar tissue, and trigger points comprises providing a spherical ball with an integrated row of "knuckles" or bumps along a section of the surface. Locating with the knuckles both general and specific target areas of the body to relieve painful myofascial conditions. The bumps on the ball are structured and configured to mimic (preferably an adult or very large set of) human knuckles in size, shape, and spacing. The ball structure and cooperation of the knuckles enable a user to control the degree of penetration to the myofascial tissue through applying variable pressure with the ball against a floor, wall, or assistance by a second user.

In embodiments, a method comprises placing the knuckles on a desired area of the body, and applying the variable and necessary pressure on the opposing (smooth round) side of the ball against a flat surface such as a wall or floor. Using a back and forth, circular, or combination of movements, the user can determine how the knuckles affect the myofascial tissue. In embodiments, trigger points are released by maintaining constant pressure at a fixed position.

In embodiments, a second user assists by gripping the ball or applying pressure using the palm of the hand to the smooth round side of the ball on the desired area of the recipient. This step can have a similar targeting effect to that described above in connection with the wall or floor (and without causing pain to the second users hand).

In embodiments, a method includes providing a massage ball having both larger and smaller knuckle-shaped nodes on one face of the ball. Positioning the patient's body on larger or smaller knuckles allows for variable depth of muscle penetration. Because the knuckles are positioned on one face of the ball, so smooth and varying adjustments can be made simply by rolling the ball in any desired direction.

In embodiments, the number of knuckles is less than 10, and in some embodiments, is less than 4. Having a small number of knuckles positioned in a row allows the user improved targeting of the myofascial tissue with limited interference by a neighboring bump or node. The embodiments described herein enable the user to be able to determine the most effective way to break up any adhesions or trigger points to find relief. The user can do so by choosing which knuckles and type of motion to manipulate the ball.

In embodiments, a method includes positioning the knuckles facing downward against a surface, allows wherein the smooth round side of the ball can be used to exert generalized pressure against different parts of the body. The user may also position the knuckles facing outward on one side. This allows for effective myofascial release by rolling on the smooth area of the ball with minimal interference from the knuckles.

In embodiments, the spacing between the rows of knuckles (e.g., on the larger ball) is sufficient to provide effective rolling of the ball along the spinous process of the user and without coming into contact with her vertebrae.

In embodiments, the spacing between the rows of knuckles (e.g., on the small ball) is sufficient to isolate the area of interest and "trap" the muscle tissue to prevent it from slipping away while pressure is applied during treatment. Non limiting examples of areas of interest include the Levator Scapulae, Pectoralis Minor, and Infraspinatus.

The description, objects and advantages of the present invention will become apparent from the detailed description to follow, together with the accompanying drawings.

DETAILED DESCRIPTION OF THE INVENTION

Before the present invention is described in detail, it is to be understood that this invention is not limited to particular variations set forth herein as various changes or modifications may be made to the invention described and equivalents may be substituted without departing from the spirit and scope of the invention. As will be apparent to those of skill in the art upon reading this disclosure, each of the individual embodiments described and illustrated herein has discrete components and features which may be readily separated from or combined with the features of any of the other several embodiments without departing from the scope or spirit of the present invention. In addition, many modifications may be made to adapt a particular situation, material, composition of matter, process, process act(s) or step(s) to the objective(s), spirit or scope of the present invention. All such modifications are intended to be within the scope of the claims made herein.

Methods recited herein may be carried out in any order of the recited events which is logically possible, as well as the recited order of events. Furthermore, where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

All existing subject matter mentioned herein (e.g., publications, patents, patent applications and hardware) is incorporated by reference herein in its entirety except insofar as the subject matter may conflict with that of the present invention (in which case what is present herein shall prevail).

Reference to a singular item, includes the possibility that there are plural of the same items present. More specifically, as used herein and in the appended claims, the singular forms "a," "an," "said" and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation. It is also to be appreciated that unless defined otherwise, all technical and scientific terms used herein have the same meaning as commonly understood by one of ordinary skill in the art to which this invention belongs.

Figure 1:
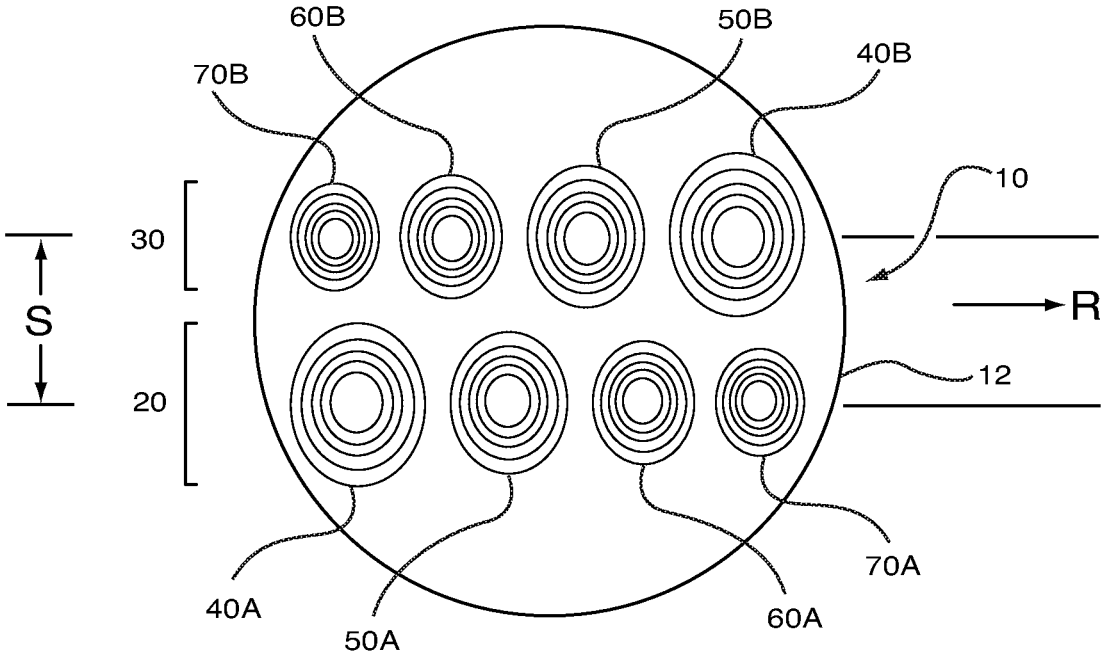
FIG. 1 depicts a top view of an 8 node massage apparatus.

FIG. 1 depicts a top view of a massage apparatus 10 comprising a spherical or ball-shaped body 12. The massage apparatus is shown having two rows of nodes 20, 30 projecting from the surface of the ball 12. Each row includes 4 nodes. Although 4 nodes per row are shown in the embodiment in FIG. 1, the number of nodes may vary. In embodiments, the number of nodes ranges between 2 and 10, and preferably is between 3-5 nodes.

The nodes shown in FIG. 1 gradually change size from the beginning of the row to the end of the row. Additionally, the rows change size in opposite directions to one another. More specifically, the nodes in row 30 increase in size in the right direction (R) whereas the nodes in row 20 decrease in size in the right direction (R).

In a preferred embodiment, a massage apparatus includes only two rows of knuckle-shaped nodes that run opposite each other and are spaced (S) approximately 1.75 inches apart, center to center. However, the spacing (S) may vary and range from 1.0-2.5 inches.

The massage apparatus may be made from a wide variety of materials. Exemplary materials include a flexible plastic or rubber material (scale A shore strength between 20-70) that may either be soft (like an eraser) or firm (like a lacrosse ball). Additionally, the components of the apparatus (namely, the nodes and body) may be prepared as solely one-piece or integrally formed, or the nodes may be attached to the body with fasteners, adhesives, or bonding techniques.

Figure 2:
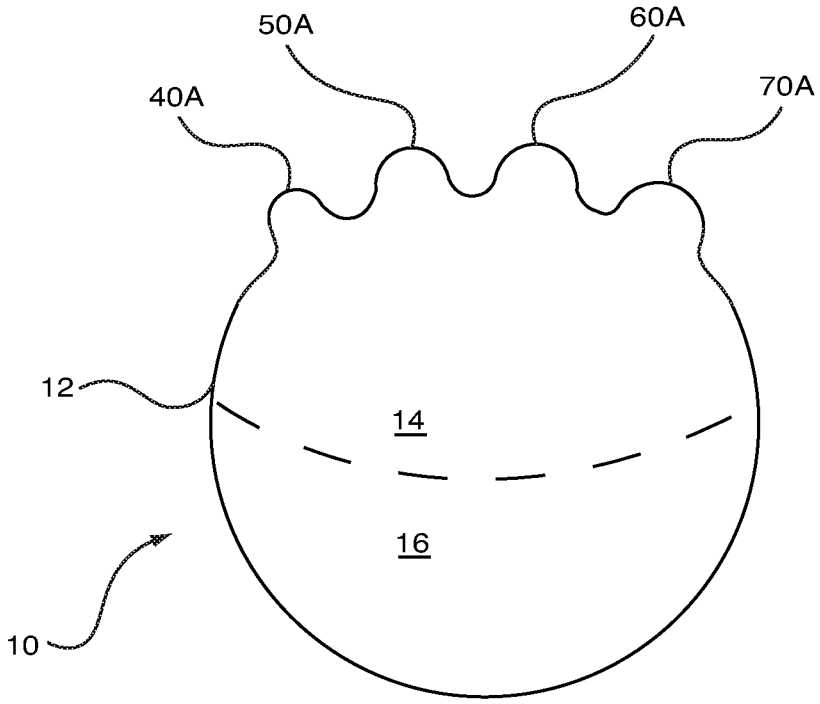
FIG. 2 depicts a front view of the massage apparatus shown in FIG. 1, rotated 90 degrees.

FIG. 2 depicts a front view of the massage apparatus 10, showing a single row of knuckles 20 in descending order (40A, 50A, 60A, 70A) from left to right. The opposing row of knuckles 30 is not visible, but would be in ascending order 70B, 60B, 50B, 40B from left to right.

The nodes shown in FIG. 2 are present on only a first hemispherical surface 14 or half of the body 10. A second hemispherical surface or portion 16 of the body, opposite to the first half, is shown as smooth, and node-less. In embodiments, the nodes and rows or nodes are disposed in only one-third or quarter sector of the massage apparatus, allowing the smooth node-less surface to be readily handled, or placed against various supporting surfaces as described herein.

Figure 3:
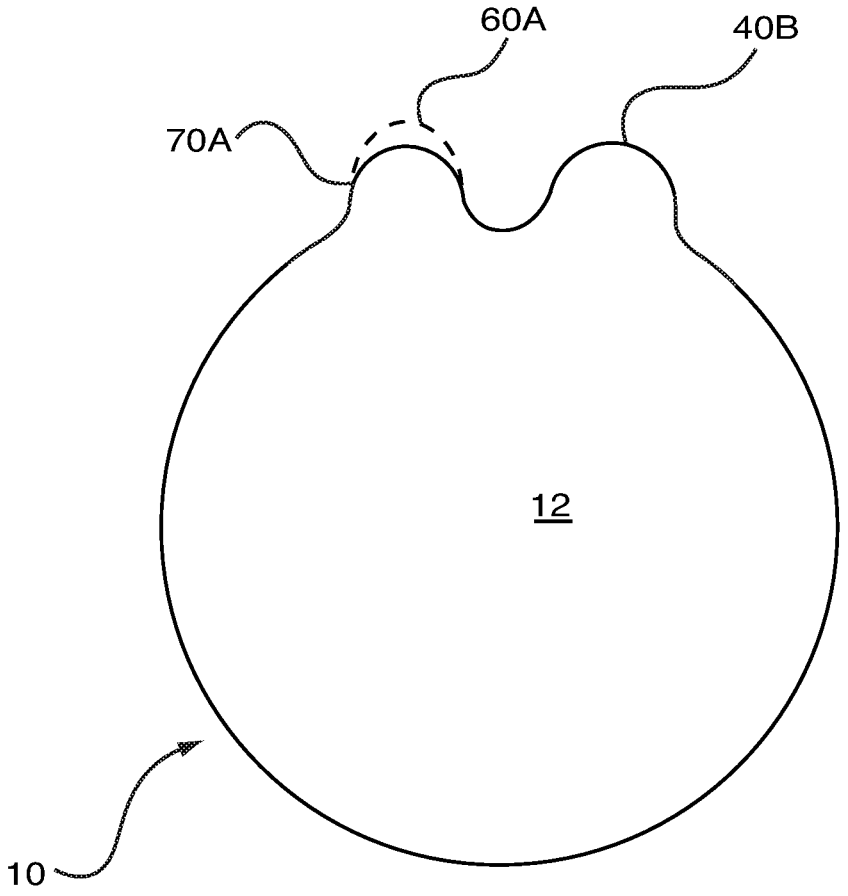
FIG. 3 depicts a right side view of the massage apparatus shown in FIG. 1.

FIG. 3 illustrates a right side view of massage apparatus 10, and rotated 90 degrees. FIG. 3 shows clear profiles of the large knuckle-like node 40B, and the small knuckle like node 70A. The next largest knuckle 60A is also depicted by dashed lines to illustrate the increasing knuckle size down the row 70A, 60A, 50A, 40A.

In embodiments, the nodes in a row change size gradually, and in some embodiments, the nodes change size in even or proportionally even amounts.

The node (such as node 40B) is shown having a conical shape commencing with an enlarged base region, and tapering to an oval or egg-shaped top. The knuckle-like nodes may vary in size (e.g., between 0.25 to 1.0 inches in diameter), spacing (e.g., between 0.50 and 2.0 inches center to center), and height (e.g., between 0.25 and 0.75 inches at the center).

Although the massage apparatus has been described specifically above, it is to be understood that the size and shape of the massage apparatus may vary widely except as where limited in the appended claims. For example, non-limiting exemplary shapes of the body include ovoid, egg-shaped, and spherical. Exemplary diameters of the massage apparatus range between 2 inches and 5 inches, preferably about 4 inches. In embodiments, the massage apparatus is the size of a large human fist, and the nodes are sized to correspond to the four knuckles of the hand excluding the thumb.

Figure 4A:
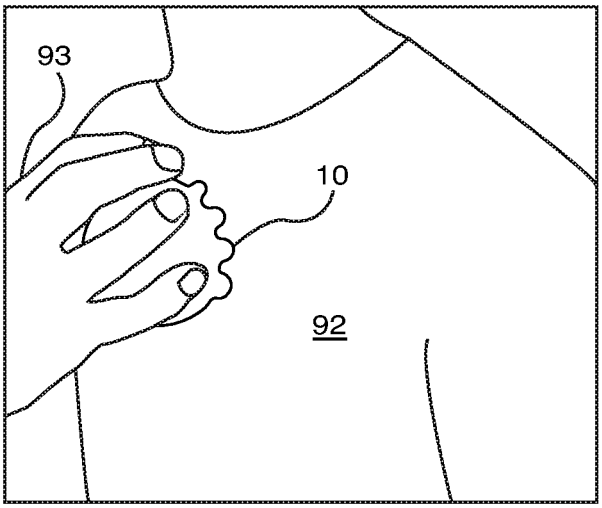
FIG. 4A depicts a massage apparatus in a chest therapy application.
Figure 4B:
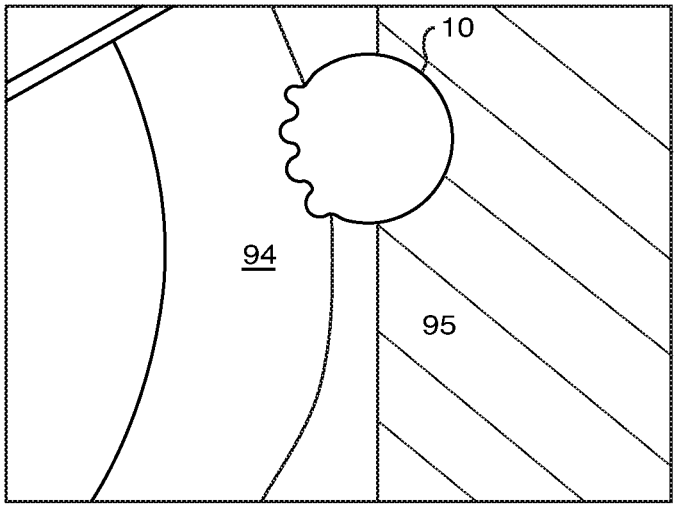
FIG. 4B depicts a massage apparatus in a back therapy application.
Figure 4C:
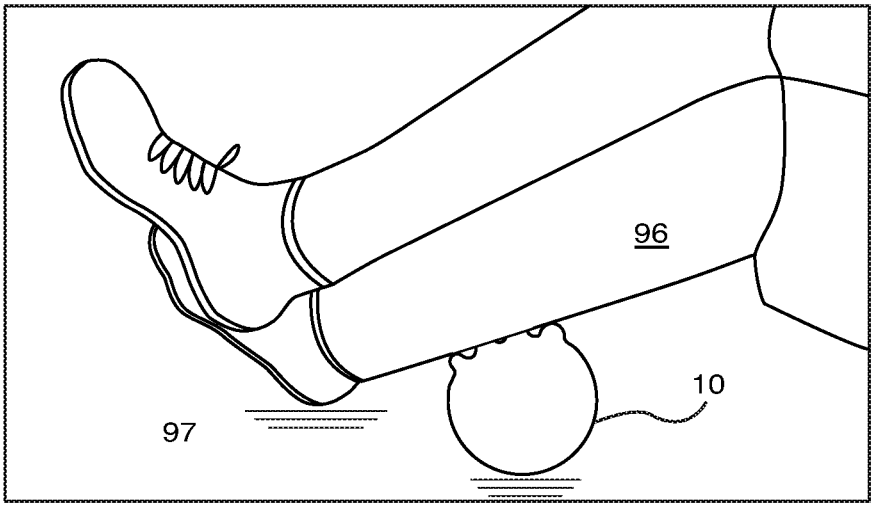
FIG. 4C depicts a massage apparatus in a leg therapy application.

FIGS. 4A-4C depicts a massage apparatus 10 in various applications.

FIG. 4A depicts a massage apparatus in a chest therapy application. The node-side of a massage apparatus 10 is urged against the chest 92 of a patient. The patient conveniently manipulates the massage apparatus 10 with her hand 93, holding the smooth curved face.

FIG. 4B depicts a massage apparatus in a back therapy application. The massage apparatus is being applied against the patient's spine 94. The massage apparatus 10 is wedged between the back 94 of the patient and a wall 95 to direct forces into the myofascial tissue for relief and repair.

FIG. 4C depicts a massage apparatus in a leg therapy application. The massage apparatus is being applied against the patient's calf muscle 96. The smooth side of the massage apparatus is placed and supported by floor 97, and the node side of the massage apparatus 10 is urged against the patient's calf. The effectiveness or forces are enhanced by the weight of the patient's legs, and gravity.

Figure 5:
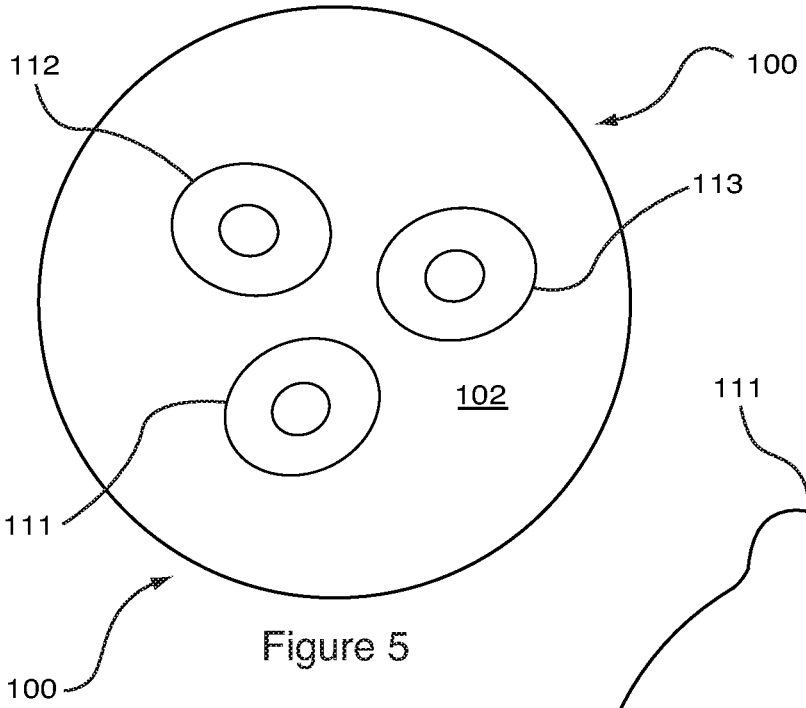
FIG. 5 depicts a top view of another massage apparatus having 3 nodes.

A top view of another massage apparatus 100 is shown in FIG. 5. The massage device 100 has a spherical ball-shaped body 102 and only three knuckle-shaped nodes 111, 112, 113 projecting from the face of the body.

In a sense, the massage apparatus 100 is shown having one row of nodes (consisting of nodes 111, 112) projecting from the surface of the body 102 and a single node 113 offset from the first row and projecting from the body 102. Although 2 nodes per row are shown in the embodiment in FIG. 5, the number of nodes per row may vary. And the number of nodes projecting from the ball may vary.

Figure 7:
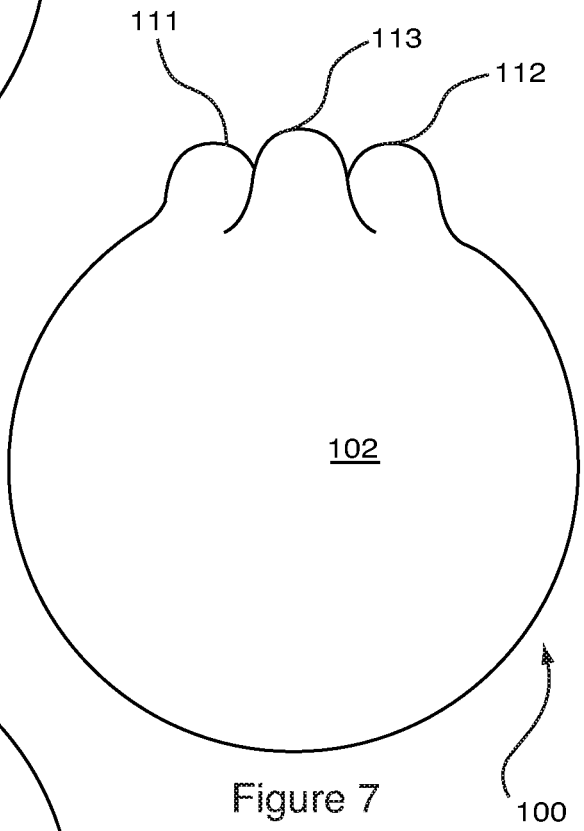
FIG. 7 depicts a right side view of the massage apparatus shown in FIG. 5, rotated 90 degrees.
Figure 6:
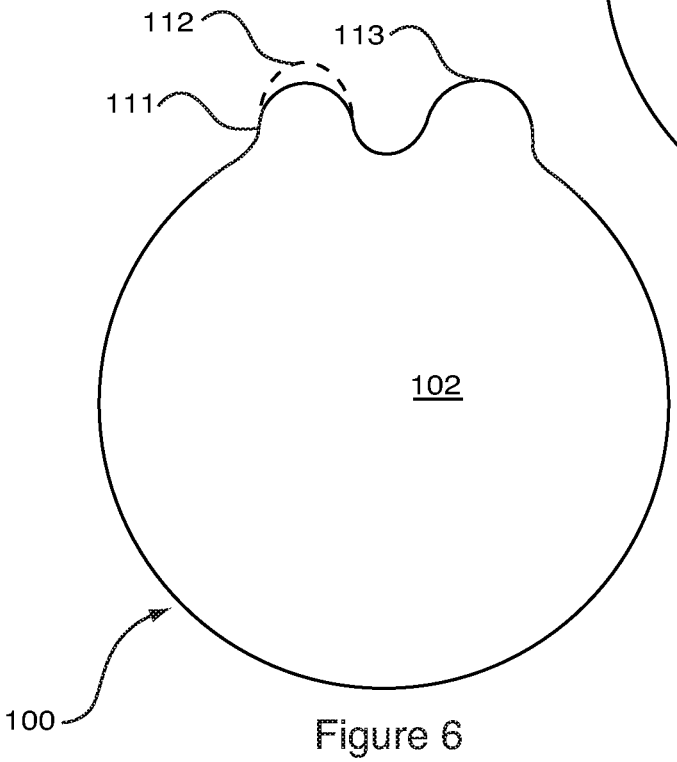
FIG. 6 depicts a front view of the massage apparatus shown in FIG. 5 showing 2 nodes.

With reference to FIGS. 6-7, the nodes are present on only a first hemispherical surface 104 or half of the body 100. A second hemispherical surface or portion 106 of the body, opposite to the first half, is shown as smooth and node-less.

In embodiments, the nodes and rows or nodes are disposed in only one-third or quarter sector of the massage apparatus, allowing the smooth node-less surface to be readily handled, or placed against various supporting surfaces as described herein.

FIG. 6 depicts a front view of massage apparatus 100. Knuckles 111, 113 are visible from left to right, with knuckle 112 depicted by a dashed line (behind knuckle 111).

FIG. 7 is a right side view of massage apparatus 100 showing knuckles 111, 113, 112 from left to right (respectively).

In embodiments, the nodes in a row change size gradually, and in some embodiments, the nodes change size in even or proportionally even amounts.

The node (such as node 111) is shown having a conical shape commencing with an enlarged base region, and tapering to an oval or egg-shaped top. The knuckle-like nodes may vary in size (e.g., between 0.25 to 1.0 inches in diameter), spacing (e.g., between 0.50 and 2.0 inches center to center), and height (e.g., between 0.25 and 0.75 inches at the center). For massage apparatus 100 shown in FIG. 5, the nodes are representative of the lower values specified above in size, spacing, and height.

Although the massage apparatus has been described specifically above, it is to be understood that the size and shape of the massage apparatus may vary widely except as where limited in the appended claims. For example, non-limiting exemplary shapes of the body include ovoid, egg-shaped, and spherical. Exemplary diameters of the massage apparatus range between 2 inches and 5 inches, preferably about 2.5 inches for the smaller embodiment. In embodiments, the massage apparatus is the size of a human fist, and the nodes are sized to correspond to at least two knuckles of the hand, excluding the thumb.

Although a number of embodiments have been disclosed above, it is to be understood that other modifications and variations can be made to the disclosed embodiments without departing from the subject invention.

The invention claimed is:

1. A massage apparatus comprising:

a spherical-shaped body defining a first face and a second face opposite the first face;

a first row of protruding nodes located on the first face; and wherein the protruding nodes of the first row vary in height in a first direction; and a second row of protruding nodes located on the first face and parallel to the first row; and wherein the second face is node-less; and wherein the protruding nodes of the first row increase in height sequentially in a first direction; and wherein each of said nodes comprises a conical shape including an enlarged base and an oval-shaped top smaller in diameter than the base.

2. The massage apparatus of claim 1, wherein the spherical-shaped body is made of a firm material.

3. The massage apparatus of claim 1, wherein the protruding nodes of the second row sequentially decrease in height in the first direction.

4. The massage apparatus of claim 3, wherein the first row and second row are the only rows of protruding nodes in the first face.

5. The massage apparatus of claim 1, wherein the top of each node ranges in diameter from 0.25 to 1 inch.

6. The massage apparatus of claim 1, comprising a center to center spacing between each adjacent node in the range between 0.50 and 2.0 inches at the top.

7. The massage apparatus of claim 1, wherein the space between the first row and the second row is sufficient to enable effective rolling of the spherical-shaped body along a spinous process of the user and without coming into contact with the vertebrae of the user.

8. The massage apparatus of claim 1, wherein the first face includes not more than 8 protruding nodes.

9. A massage apparatus comprising:

a spherical-shaped body defining a first face and a second face opposite the first face;

a first row of protruding nodes located on the first face, and wherein the protruding nodes of the first row increase in size in a first direction;

a second row of protruding nodes located on the first face and parallel to the first row, and wherein the protruding nodes of the second row decrease in size in the first direction; and a gap between the first row and second row in the range from 1 to 2.5 inches.

10. The massage apparatus of claim 9, wherein the protruding nodes of the first row evenly increase in size in the first direction.

11. The massage apparatus of claim 9, wherein the second face is node-less.

12. The massage apparatus of claim 9, wherein the first face includes not more than 8 protruding nodes.

13. A massage apparatus comprising:

a fist-sized ball made of a material having a shore A strength between 20 and 70, and defining a first hemispherical face and a first radius, a second hemispherical face opposite the first hemispherical face, a first pole, and a second pole opposite the first pole; and a plurality of protruding knuckle-shaped members extending from the first hemispherical face and beyond the first radius, and wherein each knuckle-shaped member has a height different than an adjacent knuckle-shaped member; and wherein the second hemispherical face has a smooth surface; and wherein the first hemispherical face includes not more than 3 knuckle-shaped members.

14. The massage apparatus of claim 13 wherein at least a set of the plurality of protruding knuckle-shaped members extend from the first hemispherical face and are arranged in a first row extending from the first pole to the second pole, and the protruding knuckle-shaped members increase in size along the row.

15. The massage apparatus of claim 14, wherein the protruding knuckle-shaped members have a triangular arrangement.

16. The massage apparatus of claim 13, wherein the fist-sized ball and plurality of protruding knuckle-shaped members are a one piece molded elastomer or one piece molded rubber.

17. The massage apparatus of claim 13, wherein the fist-sized ball is made of a firm material.

* * * * *